US011749165B2

(12) United States Patent
Chen et al.

(10) Patent No.: US 11,749,165 B2
(45) Date of Patent: Sep. 5, 2023

(54) BRIGHTNESS PARAMETER CORRECTION METHOD AND DEVICE AND BRIGHTNESS COMPENSATION SYSTEM

(71) Applicant: Kunshan New Flat Panel Display Technology Center Co., Ltd., Jiangsu (CN)

(72) Inventors: Feng Chen, Kunshan (CN); Xiaoyu Gao, Kunshan (CN)

(73) Assignee: Kunshan New Flat Panel Display Technology Center Co., Ltd., Kunshan (CN)

( * ) Notice: Subject to any disclaimer, the term of this patent is extended or adjusted under 35 U.S.C. 154(b) by 0 days.

(21) Appl. No.: 17/966,013

(22) Filed: Oct. 14, 2022

(65) Prior Publication Data

US 2023/0030179 A1 Feb. 2, 2023

Related U.S. Application Data

(63) Continuation of application No. PCT/CN2021/093824, filed on May 14, 2021.

(30) Foreign Application Priority Data

Jul. 29, 2020 (CN) ..... 202010746063.7

(51) Int. Cl.
*G09G 3/20* (2006.01)

(52) U.S. Cl.
CPC ... *G09G 3/2074* (2013.01); *G09G 2320/0233* (2013.01); *G09G 2320/0276* (2013.01);
(Continued)

(58) Field of Classification Search
CPC ..... G09G 3/2074; G09G 2320/0233; G09G 2320/0276; G09G 2320/0673;
(Continued)

(56) References Cited

U.S. PATENT DOCUMENTS

2013/0120659 A1* 5/2013 Park ..... H04N 5/202 348/E5.074
2016/0284272 A1* 9/2016 Her ..... G09G 3/035
(Continued)

FOREIGN PATENT DOCUMENTS

CN 102176739 B 3/2013
CN 107578760 A 1/2018
(Continued)

OTHER PUBLICATIONS

International search report (including English translation) and Written Opinion of the International Searching Authority dated Jul. 28, 2021 in corresponding to International Application No. PCT/CN2021/093824; 11 pages.

*Primary Examiner* — Kenneth B Lee, Jr.
(74) *Attorney, Agent, or Firm* — Maier & Maier, PLLC

(57) ABSTRACT

A brightness parameter correction method and device and a brightness compensation system. The method includes: obtaining a first to-be-tested brightness parameter of a designated sample display panel at a first gray level; obtaining a first deviation parameter between the first to-be-tested brightness parameter and a reference brightness; calculating a correction coefficient based on the first to-be-tested brightness parameter and the reference brightness parameter when the first deviation parameter is greater than a first preset standard threshold, the correction coefficient being such that a corrected first deviation parameter between a corrected first to-be-tested brightness parameter and the reference brightness parameter is less than or equal to the first preset standard threshold; obtaining a second to-be-tested brightness parameter of a target display panel at the first gray level; and correcting the second to-be-tested brightness parameter using the correction coefficient to obtain a corrected second to-be-tested brightness parameter.

16 Claims, 13 Drawing Sheets

(52) U.S. Cl.
CPC ..... *G09G 2320/0673* (2013.01); *G09G 2320/0686* (2013.01); *G09G 2360/147* (2013.01); *G09G 2360/16* (2013.01)

(58) Field of Classification Search
CPC ..... G09G 2320/0686; G09G 2360/147; G09G 2360/16
See application file for complete search history.

(56) References Cited

U.S. PATENT DOCUMENTS

| | | | | |
|---|---|---|---|---|
| 2017/0323619 | A1* | 11/2017 | Lee | G09G 5/10 |
| 2018/0061298 | A1* | 3/2018 | Cho | G09G 3/3666 |
| 2019/0172398 | A1* | 6/2019 | Shin | G09G 3/20 |
| 2020/0118503 | A1* | 4/2020 | Chen | G09G 3/3611 |
| 2020/0135148 | A1* | 4/2020 | Bai | G09G 3/20 |

FOREIGN PATENT DOCUMENTS

| | | | |
|---|---|---|---|
| CN | 108550345 | A | 9/2018 |
| CN | 109872687 | A | 6/2019 |
| CN | 109979389 | A | 7/2019 |
| CN | 110310237 | A | 10/2019 |
| CN | 110599957 | A | 12/2019 |

* cited by examiner

BRIGHTNESS PARAMETER CORRECTION METHOD AND DEVICE AND BRIGHTNESS COMPENSATION SYSTEM

CROSS REFERENCE TO RELATED APPLICATION

This application is a continuation of International Application No. PCT/CN2021/093824 filed on May 14, 2021, which claims priority to Chinese Patent Application No. 202010746063.7, filed on Jul. 29, 2020, both of which are hereby incorporated by reference in their entireties.

TECHNICAL FIELD

The present application relates to the field of display technology, and in particular, to brightness parameter correction method, apparatus and device and brightness compensation system.

BACKGROUND

During the displaying of a display panel, a Mura phenomenon may be occurred, which degrades the display effect of the display panel. In order to avoid the occurring of the Mura phenomenon, a Demura compensation may be performed on the display panel.

However, since a poor consistency and a poor stability of different machines used for the Demura compensation, the brightness parameters obtained from the display panels of the same type by brightness acquisition devices of the different machines may be quite different from one another. As a result, for the display panels of the same type but assigned to the different machines, the effects of the compensation algorithm for the Demura compensation may not be desirable.

SUMMARY

The embodiments of the present application provide a brightness parameter correction method, apparatus and device and a brightness compensation system, which may eliminate the adverse influence resulting from a poor consistency and a poor stability of different machines used for a brightness compensation, and improve the compensation effect of a compensation algorithm.

In a first aspect, an embodiment of the present application provides a brightness parameter correction method comprising: obtaining a first to-be-tested brightness parameter of a designated sample display panel at a first gray level; obtaining a first deviation parameter between the first to-be-tested brightness parameter and a reference brightness parameter of the designated sample display panel at the first gray level; calculating a correction coefficient based on the first to-be-tested brightness parameter and the reference brightness parameter if the first deviation parameter is greater than a first preset standard threshold, the correction coefficient being such that the first deviation parameter between a corrected first to-be-tested brightness parameter using the correction coefficient and the reference brightness parameter is less than or equal to the first preset standard threshold; obtaining a second to-be-tested brightness parameter of a target display panel to be compensated at the first gray level; and correcting the second to-be-tested brightness parameter using the correction coefficient to obtain a corrected second to-be-tested brightness parameter for a brightness compensation of the target display panel.

In a second aspect, an embodiment of the present application provides a brightness parameter correction apparatus comprising: a first obtaining module, configured to obtain a first to-be-tested brightness parameter of a designated sample display panel at a first gray level; a first calculating module, configured to obtain a first deviation parameter between the first to-be-tested brightness parameter and a reference brightness parameter of the designated sample display panel at the first gray level; a correction module, configured to calculate a correction coefficient based on the first to-be-tested brightness parameter and the reference brightness parameter if the first deviation parameter is greater than a first preset standard threshold, the correction coefficient being such that the first deviation parameter between a corrected first to-be-tested brightness parameter using the correction coefficient and the reference brightness parameter is less than or equal to the first preset standard threshold; and a second obtaining module, configured to obtain a second to-be-tested brightness parameter of a target display panel to be compensated at the first gray level; wherein the correction module is further configured to correct the second to-be-tested brightness parameter using the correction coefficient to obtain a corrected second to-be-tested brightness parameter for a brightness compensation of the target display panel.

In a third aspect, an embodiment of the present application provides a brightness parameter correction device comprising a processor, a memory, and a computer program stored on the memory and executable by the processor, wherein the computer program when executed by the processor causes the processor to implement the brightness parameter correction method according to the technical solution of the first aspect.

In a fourth aspect, an embodiment of the present application provides brightness compensation system comprising the brightness parameter correction device according to the technical solution of the third aspect and a display panel; wherein the display panel is configured to receive the corrected second to-be-tested brightness parameter output by the brightness parameter correction device, and perform the brightness compensation by applying a compensation algorithm with the corrected second brightness parameter.

Embodiments of the present application provide a brightness parameter correction method, apparatus and device and a brightness compensation system, which may obtain a first to-be-tested brightness parameter of a designated sample display panel at a first gray level. A correction coefficient is calculated based on the first to-be-tested brightness parameter and a reference brightness parameter of the designated sample display panel if a first deviation parameter between the first to-be-tested brightness parameter and the reference brightness parameter is greater than a first preset standard threshold. The first to-be-tested brightness parameter is corrected using the correction coefficient so that the first deviation parameter between the corrected first to-be-tested brightness parameter and the reference brightness parameter is less than or equal to the first preset standard threshold. That is, the correction coefficient may eliminate the adverse influence resulting from the poor consistency and the poor stability of the different machines used for the brightness compensation. The brightness parameter correction method of the present application can be used in the brightness compensations for the target display panels of the same type by the different machines. Therefore, for the target display panels needing the brightness compensation, the second to-be-tested brightness parameter corrected with the correction coefficient may eliminate the adverse influence resulting from the poor consistency and the poor stability of the machines used for the brightness compensation, and the compensation effects of the compensation algorithm can be improved by performing the brightness compensation on the target display panels with the corrected second to-be-tested brightness parameter.

BRIEF DESCRIPTION OF THE DRAWINGS

The present application may be better understood from the following description of detailed description of the present application, in conjunction with figures of the accompanying drawings in which the same or similar reference numerals refer to the same or similar features and wherein.

DETAILED DESCRIPTION

Features and exemplary embodiments of various aspects of the present application will be described in detail below, to make the objects, technical solutions, and advantages of the present application clearer. The present application will be further described in detail below with reference to the accompanying drawings and specific embodiments. It should be understood that the specific embodiments described herein are merely intended to explain the present application, rather than to limit the present application. For a person skilled in the art, the present application can be implemented without some of these specific details. The following description of the embodiments is merely to provide a better understanding of the present application by illustrating the examples of the present application.

The display panel in the embodiments of the present application may particularly be an Organic Light Emitting Diode (OLED) display panel, which is not limited herein.

Figure 1:
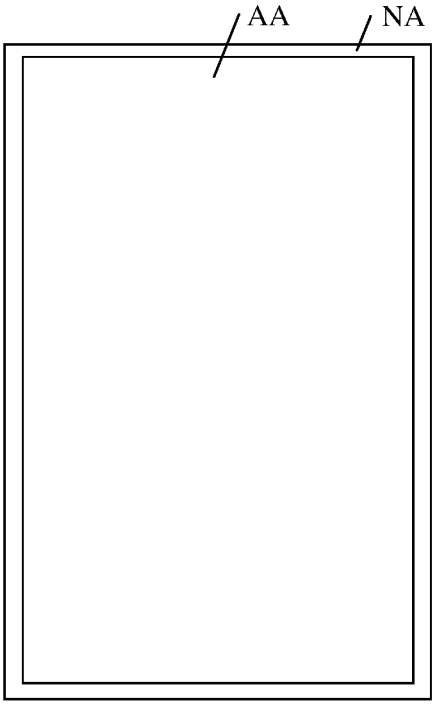
FIG. 1 is a schematic diagram of an example of a display panel according to an embodiment of the present application.

FIG. 1 is a schematic diagram of an example of a display panel according to an embodiment of the present application. As shown in FIG. 1, the display panel may include a display area AA and a non-display area NA. The display area AA may display images. The display area AA may include sub-pixels. The light colors of the sub-pixels are not limited herein. In some examples, the display area AA may include the sub-pixels emitting light of at least one color. For example, the display area AA may include the sub-pixels emitting lights of three colors. In particular, the display area AA may include the sub-pixels emitting red light, the sub-pixels emitting blue light and the sub-pixels emitting green light.

During the displaying of the display panel, the brightness values of the different display areas of the display panel may be different from one another, that is, the brightness values of the display areas are not uniform, which degrades the display effect of the display panel. In order to improve the display effect, a Demura compensation may be performed on the display panel to reduce the difference between the brightness values of the display areas.

However, since a poor consistency and a poor stability of different machines used for a brightness compensation, the brightness parameters obtained from the display panels of the same type by the different machines, may be quite different from one another. Applying the compensation algorithm to perform the brightness compensation with these brightness parameters which may be quite different from one another on the display panels may result in undesirable or even degraded compensation effects. For example, by using a same compensation algorithm, the compensation effect of the brightness compensation based on the brightness parameter(s) obtained by an machine A may be desirable, while the compensation effect of the brightness compensation based on the brightness parameter(s) obtained by an machine B may not be desirable. As another example, by using a same compensation algorithm, the compensation effect of the brightness compensation based on the brightness parameter(s) obtained by an machine A first may be desirable, but after the module or other configuration of the machine A has been changed at least one time, the compensation effect of the brightness compensation based on the brightness parameter(s) obtained by the machine A then may not be desirable any more.

In order to solve the above problem, the embodiments of the present application provide a brightness parameter correction method, apparatus and device and a brightness compensation system. The following will describe the various embodiments of the brightness parameter correction method, apparatus and device and the brightness compensation system with reference to the accompanying drawings.

Figure 2:
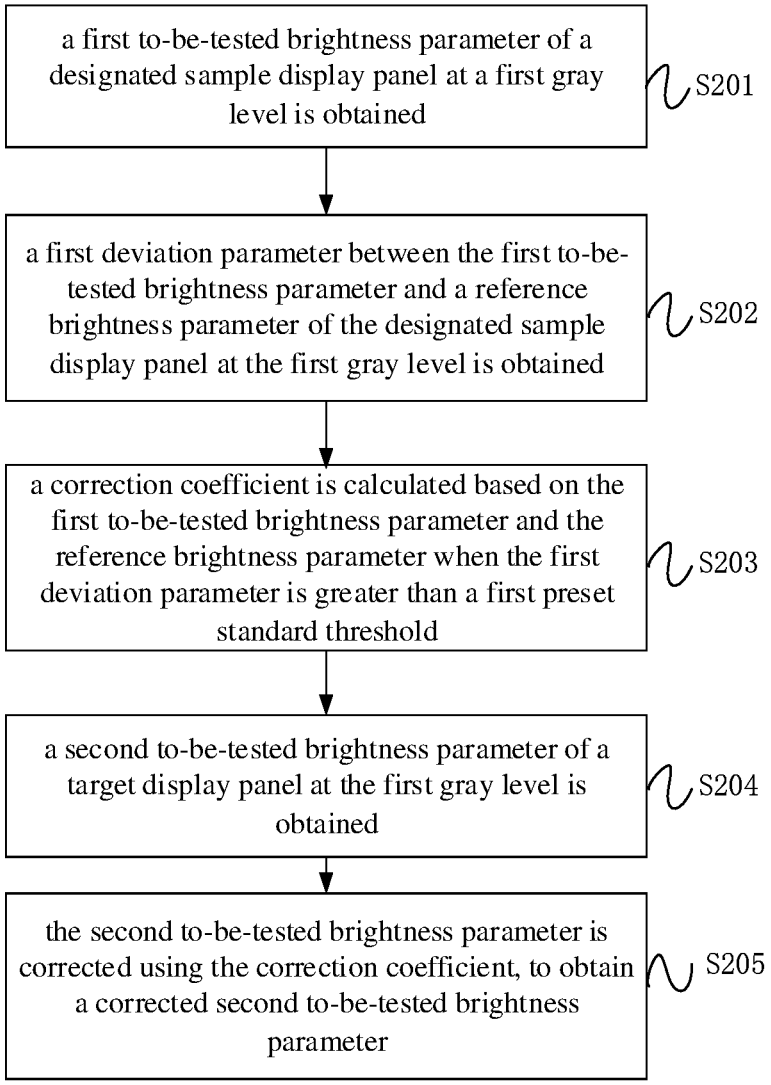
FIG. 2 is a flowchart of an example of a brightness parameter correction method according to an embodiment of the present application.

The embodiments of the present application provides a brightness parameter correction method, which may be applied to each of the machines used for the Demura compensation, that is, each of the machines may perform this brightness parameter correction method. FIG. 2 is a flowchart of an example of a brightness parameter correction method according to an embodiment of the present application. As shown in FIG. 2, the brightness parameter correction method may include steps S201 to S205.

In step S201, a first to-be-tested brightness parameter of a designated sample display panel at a first gray level is obtained.

After the designated sample display panel is powered on, the designated sample display panel may be photographed by using a high-resolution and high-precision camera installed on the machine used for the brightness compensation, such as a Charge Coupled Device (CCD) camera, to generate CSV data. The entire display area of the designated sample display panel may be photographed, that is, the photographed area includes the whole of the display area of the designated sample display panel. Alternatively, a portion of the display area of the designated sample display panel may be photographed, that is, the photographed area includes a portion of the display area of the designated sample display panel.

The CSV data may include brightness parameters of the sub-pixels emitting lights of respective target colors in the photographed area of the designated sample display panel at the first gray level. The CSV data may be particularly implemented with CSV data files, that is, the CSV data files store the brightness parameters of the sub-pixels emitting lights of respective target colors in the photographed area of the designated sample display panel at the first gray level. For example, a CapRas_032_B.CSV file may store the brightness parameters of the sub-pixels emitting blue light in the photographed area of the designated sample display panel at a gray level of 32. As another example, a CapRas_224_R.CSV file may store the brightness parameters of the sub-pixels emitting red light in the photographed area of the designated sample display panel at a gray level of 224.

In some examples, the brightness parameters of the sub-pixels emitting lights of respective target colors in the display area of the designated sample display panel at the first gray level may be obtained by photographing the designated sample display panel once or twice or more, which is not limited herein.

The sub-pixels emitting lights of respective target colors may be first sub-pixels emitting light of one specific color in the display area. For one designated sample display panel, with respect to the sub-pixels emitting light of each color, a corresponding first to-be-tested brightness parameter may be obtained.

The first gray level is one gray level of the gray levels that can be sampled by the machine, which is not limited herein. For one designated sample display panel, first to-be-tested brightness parameters of the designated sample display panel at respective gray levels may be obtained by calculation.

The first to-be-tested brightness parameter is a parameter calculated based on the brightness parameters of different sub-pixels emitting lights of the respective target colors in the designated sample display panel at the first gray level, and may represent a discrete degree of the brightness values of different portions of the display area of the designated sample display panel. The brightness parameters may particularly include parameters such as brightness values, which is not limited herein.

In some examples, the designated sample display panel is a display panel that the gamma (i.e., the Gamma) adjustment effect of each of a first display area and a second display area of the display panel satisfies a predetermined standard, the difference between a visual brightness of the first display area and a visual brightness of the second display area is within an allowable range, and the uniformity between the first display area and the second display area satisfies a predetermined uniformity requirement. That is, the designated sample display panel is a display panel of good quality, for example, with a quality of level A.

In step S202, a first deviation parameter between the first to-be-tested brightness parameter and a reference brightness parameter of the designated sample display panel at the first gray level is obtained.

The respective reference brightness parameters of the designated sample display panel at the gray levels may be obtained first. Herein the respective reference brightness parameters of the designated sample display panel at the gray levels are obtained under the same conditions. Then a first deviation parameter between the first to-be-tested brightness parameter of the designated sample display panel at the first gray level and a reference brightness parameter of the designated sample display panel at the first gray level may be calculated. The first deviation parameter may represent a degree of deviation of the first to-be-tested brightness parameter from the reference brightness parameter. The greater the first deviation parameter, the higher the degree of the deviation of the first to-be-tested brightness parameter at a specific gray level from the reference brightness parameter at the specific gray level is.

In step S203, a correction coefficient is calculated based on the first to-be-tested brightness parameter and the reference brightness parameter if the first deviation parameter is greater than a first preset standard threshold.

The first deviation parameter being greater than the preset standard threshold indicates that the degree of the deviation of the first to-be-tested brightness parameter from the reference brightness parameter is out of an acceptable range, which indicates that the configuration of the present machine obtaining the first to-be-tested brightness parameter is different from the configuration of the machine obtaining the reference brightness parameter. That is, there are poor consistency and poor stability of the two machines. Thus, the first to-be-tested brightness parameter needs to be corrected using the correction coefficient. The correction coefficient allows that the first deviation parameter between a corrected first to-be-tested brightness parameter obtained by using the correction coefficient and the reference brightness parameter is less than or equal to the first preset standard threshold. That is, by using the correction coefficient, the consistency and the stability of the machine obtaining the first to-be-tested brightness parameter and the machine obtaining the reference brightness parameter can be improved. The first preset standard threshold may be set according to specific work scenarios and work requirements, and is not limited herein.

In some examples, the first deviation parameter may particularly be an absolute value of a difference between the first to-be-tested brightness parameter and the reference brightness parameter. Correspondingly, the first preset standard threshold is a standard threshold for the absolute value of the difference between the first to-be-tested brightness parameter and the reference brightness parameter, for example, the first preset standard threshold may be set to 0.2. In other examples, the first deviation parameter may particularly be a quotient of the absolute value of the difference between the first to-be-tested brightness parameter and the reference brightness parameter and the reference brightness parameter. Correspondingly, the first preset standard threshold is a standard threshold for the quotient of the absolute value of the difference between the first to-be-tested brightness parameter and the reference brightness parameter and the reference brightness parameter, for example, the first preset standard threshold may be set to 2%. The form of the first deviation parameter is not limited here.

If the first deviation parameter is less than or equal to the first preset standard threshold, it may indicate that the consistency and the stability of the two machines are desirable, and the brightness parameter(s) obtained by the present machine needs no correction. In particular, the correction coefficient may not be calculated, or the correction coefficient may be set as 1, which indicates that the brightness parameter(s) obtained by the present machine will not be changed.

In step S204, a second to-be-tested brightness parameter of a target display panel to be compensated at the first gray level is obtained.

The target display panel and the designated sample display panel are of the same type but different display panels. The number of the target display panels is not limited here. The second to-be-tested brightness parameter is a parameter calculated based on the brightness parameters of different sub-pixels emitting lights of respective target colors in the target display panel at the first gray level, and may represent a discrete degree of the brightness values of different portions of the display area of the target display panel. The brightness parameters may particularly include, but not limited to, brightness values.

The target display panel needs a Demura compensation, and the Demura compensation is to use a parameter that may represent the discrete degree of the brightness values of different portions of the display area of the target display panel, that is, the second to-be-tested brightness parameter. Since the poor consistency and the poor stability of the machines used to obtain the brightness parameters and the machine used to obtain the reference brightness parameter, the second to-be-tested brightness parameters calculated using the brightness parameters obtained by the machines may also be in poor consistency and stability. Thus, the second to-be-tested brightness parameter needs correcting to eliminate the adverse influence resulting from the poor consistency and the poor stability of the machines.

In step S205, the second to-be-tested brightness parameter is corrected using the correction coefficient, to obtain a corrected second to-be-tested brightness parameter.

The corrected second to-be-tested brightness parameter is used for a brightness compensation of the target display panel.

The correction coefficient in step S205 is the correction coefficient obtained in step S203, and the second to-be-tested brightness parameter is corrected by the correction coefficient. The corrected second to-be-tested brightness parameter is used for a brightness compensation of the target display panel. Since the corrected second to-be-tested brightness parameter is a parameter that has eliminated the adverse influence resulting from the poor consistency and the poor stability of the different machines, the compensation effect of the compensation algorithm for the Demura compensation may be improved.

A correction coefficient corresponding to a first to-be-tested brightness parameter at one gray level may be different from a correction coefficient corresponding to a first to-be-tested brightness parameter at another gray level. In this case, a correction coefficient used for correcting a second to-be-tested brightness parameter at one gray level may be the same as a correction coefficient used for correcting the first to-be-tested brightness parameter at the one gray level. Further, a correction coefficient corresponding to a first to-be-tested brightness parameter for the sub-pixels emitting light of one color at one gray level may be different from a correction coefficient corresponding to a first to-be-tested brightness parameter for the sub-pixels emitting light of another color at the one gray level. In this case, a correction coefficient used for correcting a second to-be-tested brightness parameter for the sub-pixels emitting light of one color at one gray level may be the same as a correction coefficient used for correcting the first to-be-tested brightness parameter for the sub-pixels emitting light of the one color at the one gray level.

When a plurality of the machines are used for the brightness compensation for a plurality of the display panels of the same type, each of the machines may employ the brightness parameter correction method described above to correct the second to-be-tested brightness parameter it obtained. The correction coefficients corresponding to the different machines may be different from one another, which are not limited here.

In the embodiments of the present application, a first to-be-tested brightness parameter of a designated sample display panel at a first gray level may be obtained. A correction coefficient is calculated based on the first to-be-tested brightness parameter and a reference brightness parameter of the designated sample display panel if a first deviation parameter between the first to-be-tested brightness parameter and the reference brightness parameter is greater than a first preset standard threshold. The first to-be-tested brightness parameter is corrected using the correction coefficient so that the first deviation parameter between the corrected first to-be-tested brightness parameter and the reference brightness parameter is less than or equal to the first preset standard threshold. That is, the correction coefficient may eliminate the adverse influence resulting from the poor consistency and the poor stability of the different machines used for the brightness compensation. The brightness parameter correction method of the present application can be used in the brightness compensations for the target display panels of the same type by the different machines. Therefore, for the target display panels needing brightness compensation, the second to-be-tested brightness parameter corrected with the correction coefficient may eliminate the adverse influence resulting from the poor consistency and the poor stability of the machines used for the brightness compensation, and the compensation effects of the compensation algorithm can be improved by performing the brightness compensation on the target display panels with the corrected second to-be-tested brightness parameter. Especially, for the situation that a plurality of the machines are used for the brightness compensation for a plurality of the target display panels of the same type, the compensation effects of the brightness compensation for the target display panels can be significantly improved, as the adverse influence resulting from the poor consistency and the poor stability of the machines can be eliminated.

Moreover, in the embodiments of the present application, the adverse influence resulting from the poor consistency and the poor stability of the different machines can be eliminated by the correction coefficient. Thus, in such a situation that a plurality of the machines are used for the brightness compensation for a plurality of the target display panels of the same type, the brightness parameter correction method according to the embodiments of the present application may be applied to each of the machines, and it is not necessary to configure the plurality of the machines with different compensation algorithms That is, configuring one compensation algorithm for the plurality of the machines may realize the function of providing accurate brightness compensation for the plurality of the target display panels of the same type, which may further avoid incorrect operation in loading a plurality of the different compensation algorithms and problems of the undesirable compensation effects resulting from unsuitable compensation algorithms loaded onto the machines.

Figure 3:
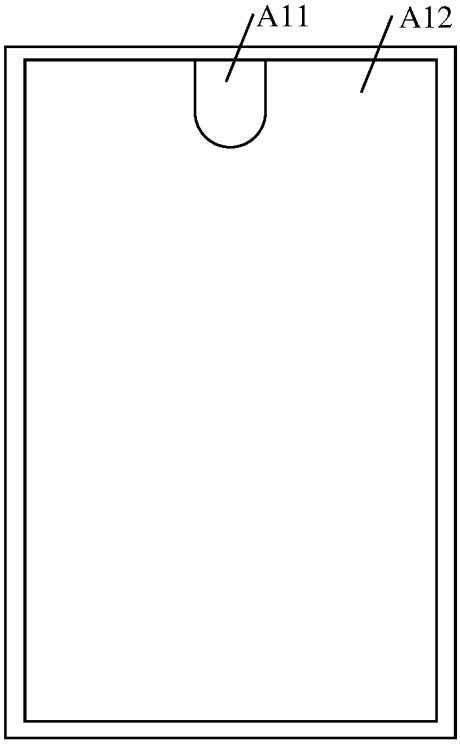
FIG. 3 is a schematic diagram of another example of a display panel according to an embodiment of the present application.

Each of the above-mentioned designated sample display panel and the target display panel corresponds to a display panel. FIG. 3 is a schematic diagram of another example of a display panel according to an embodiment of the present application. As shown in FIG. 3, the display panel may have a first display area A11 and a second display area A12. Each of the first display area A11 and the second display area A12 may display images. In some examples, the light transmittance of the first display area A11 is greater than the light transmittance of the second display area A12. The first display area A11 may be considered as a transparent display area, that is, a secondary screen area of the display panel. The second display area A12 may be considered as a main screen area of the display panel. For example, the light transmittance of the first display area A11 may be greater than or equal to 15%. In order to ensure that the light transmittance of the first display area A11 is greater than 15%, or even greater than 40%, or even higher, the light transmittance of each of functional film layers of the display panel according to the embodiment may be greater than 80%, or the light transmittances of at least some of the functional film layers may be even greater than 90%.

The first display area is disposed with a plurality of first sub-pixels, and the light color of the first sub-pixels is not limited herein. In some examples, the first display area may be disposed with the first sub-pixels emitting light of at least one color. For example, the first display area may be disposed with the first sub-pixels emitting lights of three colors, in particular, the first display area may be disposed with the first sub-pixels emitting red light, the first sub-pixels emitting blue light and the first sub-pixels emitting green light. The second display area may be disposed with a plurality of second sub-pixels, and the light color of the second sub-pixels is not limited herein. For example, the second display area may be disposed with the second sub-pixels emitting lights of three colors, in particular, the second display area may be disposed with the second sub-pixels emitting red light, the second sub-pixels emitting blue light and the second sub-pixels emitting green light.

Photosensitive components may be integrated on the backside of the first display area A11 of the display panel according to the embodiment of the present application, so as to realize an under-screen integration of the photosensitive components such as cameras. The first display area A11 may also display images, which may increase the display area of the display panel and realize a full-screen design of the display device.

In order to ensure that the light transmittance of the first display area A11 satisfies a corresponding standard requirement, the design on a pixel arrangement and a driving circuit structure of the first display area A11 may be different from that of the second display area A12. As this difference between the first display area A11 and the second display area A12, the visual brightness of the first display area A11 and the visual brightness of the second display area A12 may be different from each other. The visual brightness of the first display area A11 refers to the brightness of the first display area A11 perceived by human eyes. The visual brightness of the second display area A12 refers to the brightness of the second display area A12 perceived by human eyes.

In order to improve the display effect, the Demura compensation may be performed on the display panel to reduce the difference in the visual brightness between the first display area A11 and the second display area A12.

Figure 4:
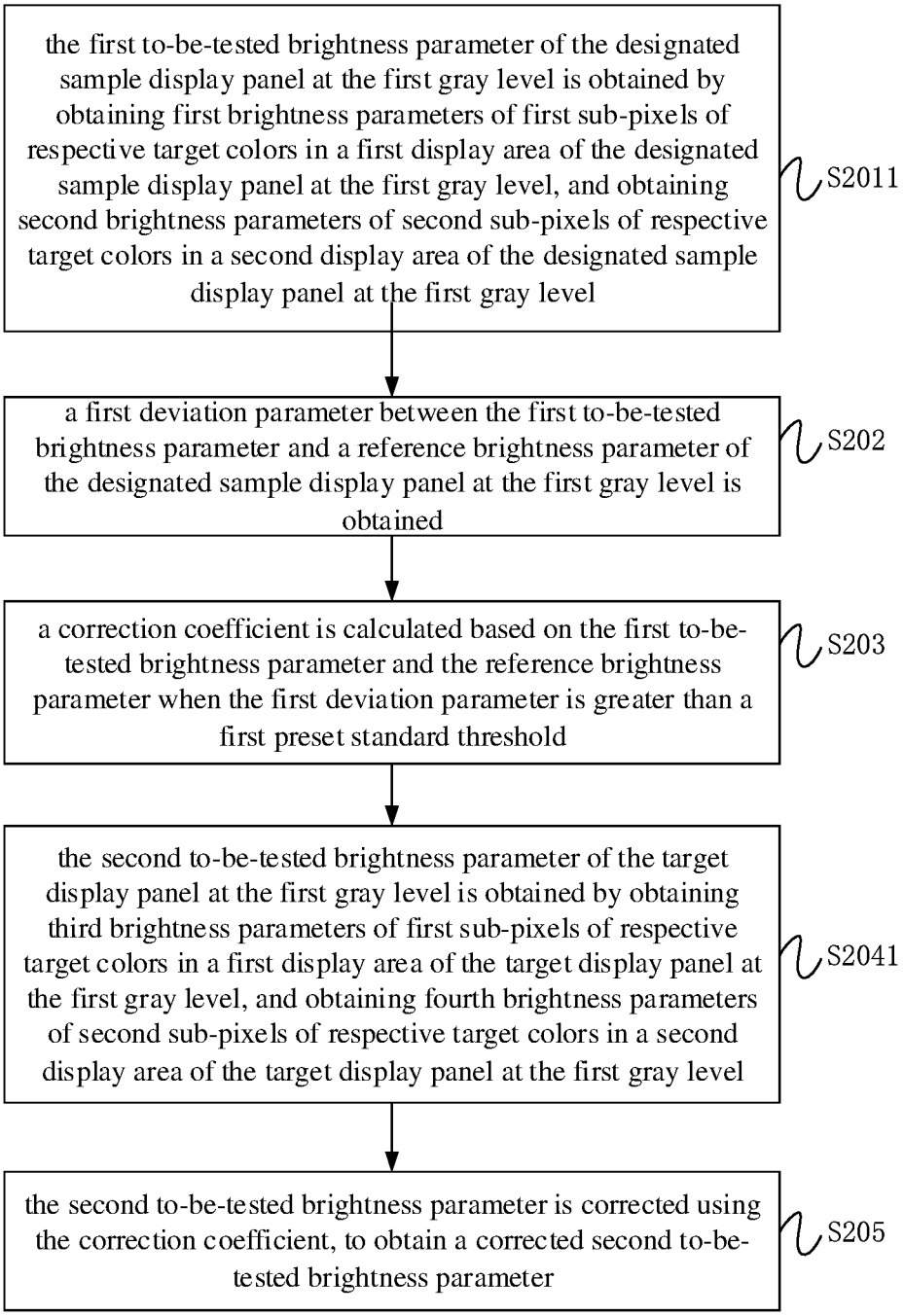
FIG. 4 is a flowchart of another example of a brightness parameter correction method according to an embodiment of the present application.

FIG. 4 is a flowchart of another example of a brightness parameter correction method according to an embodiment of the present application. The difference between FIG. 4 and FIG. 2 is that the step S201 in FIG. 2 may be particularly specified as step S2011 shown in FIG. 4, and the step S204 in FIG. 2 may be specified as step S2041 shown in FIG. 4.

In step S2011, the first to-be-tested brightness parameter of the designated sample display panel at the first gray level is obtained by obtaining first brightness parameters of the first sub-pixels emitting lights of respective target colors in the first display area of the designated sample display panel at the first gray level, and obtaining second brightness parameters of the second sub-pixels emitting lights of respective target colors in the second display area of the designated sample display panel at the first gray level.

In particular, after the designated sample display panel is powered on, the designated sample display panel may be photographed by using a high-resolution and high-precision camera installed on the machine used for brightness compensation, such as a CCD camera, to generate CSV data. The entire display area of the designated sample display panel may be photographed, that is, the photographed area includes the whole of the first display area and the whole of the second display area. Then, the first brightness parameters of all of the first sub-pixels emitting lights of respective target colors in the first display area at the first gray level are obtained, and the second brightness parameters of all of the second sub-pixels emitting lights of respective target colors in the second display area at the first gray level are obtained. Alternatively, a portion of the display area of the designated sample display panel may be photographed, that is, the photographed area may include the whole of the first display area and a portion of the second display area, or the photographed area may include a portion of the first display area and a portion of the second display area. Then, the first brightness parameters of all of the first sub-pixels emitting lights of respective target colors in the first display area at the first gray level are obtained, and the second brightness parameters of a portion of the second sub-pixels emitting lights of respective target colors in the second display area at the first gray level are obtained; or the first brightness parameters of a portion of the first sub-pixels emitting lights of respective target colors in the first display area at the first gray level are obtained, and the second brightness parameters of a portion of the second sub-pixels emitting lights of respective target colors in the second display area at the first gray level are obtained. The portion of the second display area selected may be around the first display area, which is not limited herein.

The CSV data may include the first brightness parameters of the first sub-pixels emitting lights of respective target colors and the second brightness parameters of the second sub-pixels emitting lights of respective target colors in the photographed area of the designated sample display panel at the first gray level. The CSV data may be particularly implemented with CSV data files, that is, the CSV data files store the first brightness parameters of the first sub-pixels emitting lights of respective target colors and the second brightness parameters of the second sub-pixels emitting lights of respective target colors in the photographed area of the designated sample display panel at the first gray level. For example, a CapRas_032_B.CSV file may store the first brightness parameters of the first sub-pixels emitting blue light and the second brightness parameters of the second sub-pixels emitting blue light in the photographed area of the designated sample display panel at a gray level of 32. As another example, a CapRas_224_R.CSV file may store the first brightness parameters of the first sub-pixels emitting red light and the second brightness parameters of the second sub-pixels emitting red light in the photographed area of the designated sample display panel at a gray level of 224.

In some examples, the first brightness parameters of the first sub-pixels emitting lights of respective target colors in the first display area of the designated sample display panel at the first gray level, and the second brightness parameters of the second sub-pixels emitting lights of respective target colors in the second display area of the designated sample display panel at the first gray level may be obtained by photographing the designated sample display panel twice, which is not limited herein. For example, the designated sample display panel may be photographed first, to obtain the first brightness parameters of the first sub-pixels emitting lights of respective target colors in the first display area at the first gray level, and CSV data of the first display area at the first gray level may be obtained correspondingly. Then, the designated sample display panel may be photographed again, to obtain the second brightness parameters of the second sub-pixels emitting lights of respective target colors in the second display area at the first gray level, and CSV data of the second display area at the first gray level may be obtained correspondingly.

The first sub-pixels emitting lights of a target color may be the first sub-pixels emitting lights of one of at least three colors in the first display area. The second sub-pixels emitting light of a target color may be the second sub-pixels emitting lights of one of at least three colors in the second display area. The light color of the first sub-pixels corresponding to the first brightness parameters used to obtain the first to-be-tested brightness parameter is the same as the light color of the second sub-pixels corresponding to the second brightness parameter used to obtain the first to-be-tested brightness parameter. For one designated sample display panel, with respect to the sub-pixels emitting light of each color, a corresponding first to-be-tested brightness parameter may be obtained based on the first sub-pixels emitting light of this color and the second sub-pixels emitting light of this color.

The first to-be-tested brightness parameter is a parameter calculated based on the first brightness parameters and the second brightness parameters, and may represent a discrete degree of the brightness values of the first display area and the second display area of the designated sample display panel. The first brightness parameters and the second brightness parameters may particularly include parameters such as brightness values, which is not limited herein.

In step S2041, the second to-be-tested brightness parameter of the target display panel at the first gray level is obtained by obtaining third brightness parameters of the first sub-pixels emitting lights of respective target colors in the first display area of the target display panel at the first gray level, and obtaining fourth brightness parameters of the second sub-pixels emitting lights of respective target colors in the second display area of the target display panel at the first gray level.

The third brightness parameters and the fourth brightness parameters may particularly include parameters such as brightness values, which is not limited herein. The second to-be-tested brightness parameter is a parameter calculated based on the third brightness parameters and the fourth brightness parameters, and may represent a discrete degree of the brightness values of the first display area and the second display area of the target display panel. The target display panel needs the Demura compensation, and the Demura compensation is to use a parameter that may represent the discrete degree of the brightness values of the first display area and the second display area of the target display panel, that is, the second to-be-tested brightness parameter. Since the poor consistency and the poor stability of the machines, the second to-be-tested brightness parameters obtained from the third brightness parameters and the fourth brightness parameters obtained by the machines may also be poor in consistency and stability. Thus, the second to-be-tested brightness parameter needs correcting to eliminate the adverse influence by the poor consistency and the poor stability of the different machines.

Figure 5:
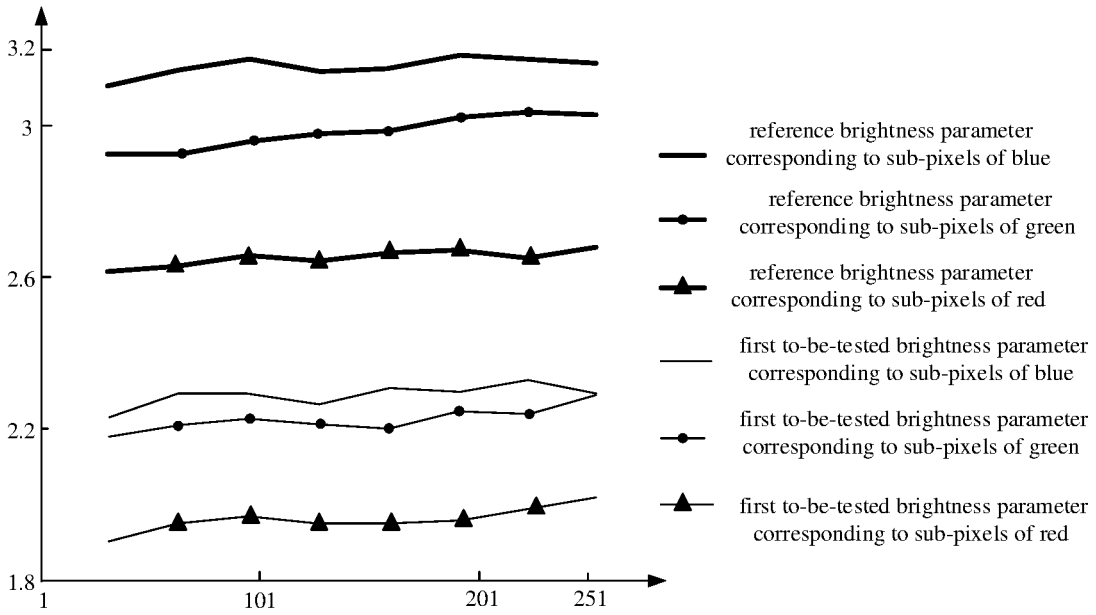
FIG. 5 is a schematic diagram of an example of reference brightness parameters and first to-be-tested brightness parameters corresponding to sub-pixels emitting lights of respective colors of a designated sample display panel according to an embodiment of the present application.

For example, FIG. 5 is a schematic diagram of an example of reference brightness parameters and first to-be-tested brightness parameters corresponding to sub-pixels emitting lights of respective colors of a designated sample display panel according to an embodiment of the present application. As shown in FIG. 5, the abscissa axis represents the gray level, and the ordinate axis represents the value of the first to-be-tested brightness parameter or the value of the reference brightness parameter. For the designated sample display panel, with respect to the sub-pixels emitting light of each color, the degree of deviation of the corresponding first to-be-tested brightness parameter from the corresponding the reference brightness parameter is relatively high, which indicates the poor consistency and the poor stability of the present machine obtaining the brightness parameters and the machine obtaining the reference brightness parameter. Thus, there may arise large errors in obtaining the first to-be-tested brightness parameters and the second to-be-tested brightness parameters for subsequent display panels to be compensated, and using such first to-be-tested brightness parameters or second to-be-tested brightness parameters obtained by the machines with the poor consistency and the poor stability to perform the brightness compensation may degrade the compensation effects of the compensation algorithm.

Figure 6:
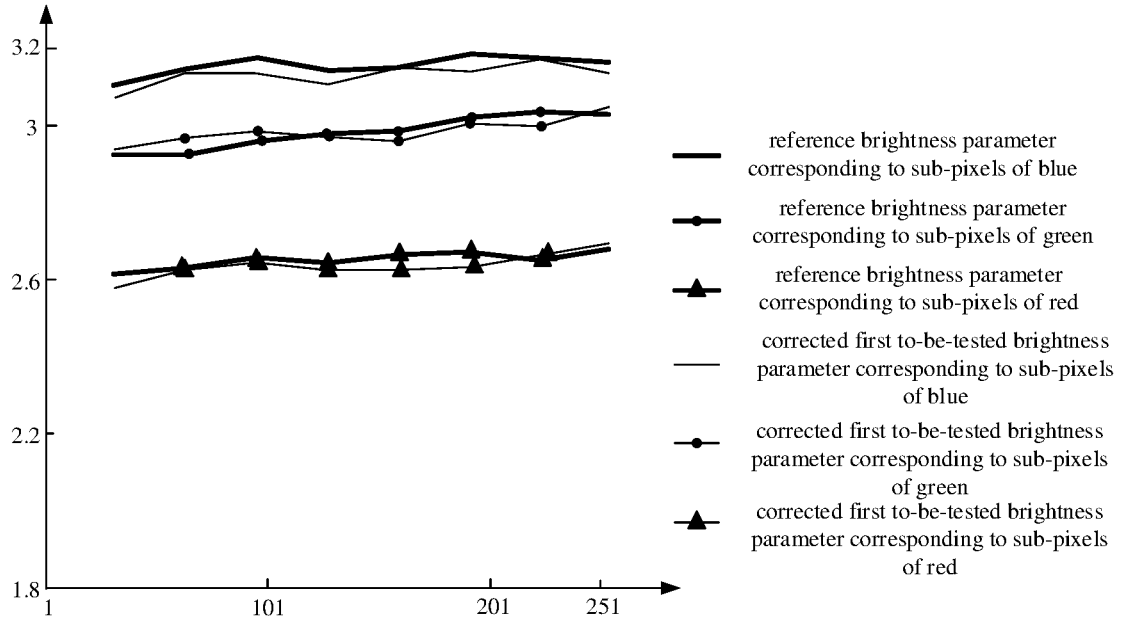
FIG. 6 is a schematic diagram of an example of reference brightness parameters and corrected first to-be-tested brightness parameters corresponding to the sub-pixels emitting lights of respective colors of the designated sample display panel according to an embodiment of the present application.

FIG. 6 is a schematic diagram of an example of reference brightness parameters and corrected first to-be-tested brightness parameters corresponding to the sub-pixels emitting lights of respective colors of the designated sample display panel according to an embodiment of the present application. As shown in FIG. 6, the abscissa axis represents the gray level, and the ordinate axis represents the value of the corrected first to-be-tested brightness parameter or the value of the reference brightness parameter. For the designated sample display panel, with respect to the sub-pixels emitting light of each color, the degree of deviation of the corresponding corrected first to-be-tested brightness parameter obtained with the correction coefficient from the corresponding reference brightness parameter being within an acceptable error range indicates that the inaccuracy of the brightness compensation may be reduced or even eliminated by the correction of the corresponding first to-be-tested brightness parameter with the correction coefficient and the following correction of a second to-be-tested brightness parameter for a target display panel with the correction coefficient, and the effect of the brightness compensation of the compensation algorithm can be improved when the subsequent brightness compensation is performed with the first to-be-tested brightness parameter corrected with the correction coefficient or the second to-be-tested brightness parameter corrected with the correction coefficient.

For the sub-pixels emitting light of the same color, the first to-be-tested brightness parameters at respective gray levels may correspond to a same correction coefficient. In this case, the curve of the corrected first to-be-tested brightness parameters which are obtained by using the correction coefficient may be shifted up or down with respect to the corresponding curve of the first to-be-tested brightness parameter along the ordinate axis. Alternatively, for the sub-pixels emitting light of the same color, the first to-be-tested brightness parameters at respective gray levels may correspond to different correction coefficients. Thus, each point on the curve of the corrected first to-be-tested brightness parameters which are obtained by the correction coefficient may be shifted up or down with respect to a corresponding point on the curve of the first to-be-tested brightness parameter along the ordinate axis.

The first to-be-tested brightness parameter is obtained based on the first brightness parameters of the first sub-pixels emitting lights of respective target colors in the first display area of the designated sample display panel at the first gray level and the second brightness parameters of the second sub-pixels emitting lights of respective target colors in the second display area of the designated sample display panel at the first gray level. The correction coefficient is calculated based on the first to-be-tested brightness parameter and the reference brightness parameter of the designated sample display panel if a first deviation parameter between the first to-be-tested brightness parameter and the reference brightness parameter is greater than a first preset standard threshold. The first to-be-tested brightness parameter is corrected using the correction coefficient so that the first deviation parameter between the corrected first to-be-tested brightness parameter and the reference brightness parameter is less than or equal to the first preset standard threshold. That is, the correction coefficient may eliminate the adverse influence resulting from the poor consistency and the poor stability of the machines used for the brightness compensation. Therefore, for the target display panels needing the brightness compensation, the second to-be-tested brightness parameter corrected with the correction coefficient may eliminate the adverse influence resulting from the poor consistency and the poor stability of the machines used for the brightness compensation, and the compensation effects of the compensation algorithm can be improved by performing the brightness compensation on the target display panels with the corrected second to-be-tested brightness parameter. Especially, for the situation that a plurality of the machines are used for the brightness compensation for a plurality of the target display panels of the same type, the compensation effects of the brightness compensation for the target display panels can be significantly improved, as the adverse influence resulting from the poor consistency and the poor stability of the machines can be eliminated.

In some examples, the first to-be-tested brightness parameter comprises a quotient of an average value of the first brightness parameters and an average value of the second brightness parameters. The average value of the first brightness parameters is an average value of the first brightness parameters of the first sub-pixels emitting lights of respective target colors in the first display area of the designated sample display panel at the first gray level. The average value of the second brightness parameters is an average value of the second brightness parameters of the second sub-pixels emitting lights of respective target colors in the second display area of the designated sample display panel at the first gray level. For example, the above relationship may be expressed as y_r1=Ave_Local_r1/Ave_main_r1, wherein, y_r1 is the first to-be-tested brightness parameter corresponding to the sub-pixels emitting red light of the designated sample display panel at the first gray level, Ave_Local_r1 is an average value of first brightness parameters of the first sub-pixels emitting red light in the first display area of the designated sample display panel at the first gray level, and Ave_main_r1 is an average value of second brightness parameters of the second sub-pixels emitting red light in the second display area of the designated sample display panel at the first gray level. For another example, the above relationship may be expressed as y_b1=Ave_Local_b1/Ave_main_b1, wherein, y_b1 is the first to-be-tested brightness parameter corresponding to the sub-pixels emitting blue light of the designated sample display panel at the first gray level, Ave_Local_b1 is an average value of first brightness parameters of the first sub-pixels emitting blue light in the first display area of the designated sample display panel at the first gray level, and Ave_main_b1 is an average value of second brightness parameters of the second sub-pixels emitting blue light in the second display area of the designated sample display panel at the first gray level. For yet another example, the above relationship may be expressed as y_g1=Ave_Local_g1/Ave_main_g1, wherein, y_g1 is the first to-be-tested brightness parameter corresponding to the sub-pixels emitting green light of the designated sample display panel at the first gray level, Ave_Local_g1 is an average value of first brightness parameters of the first sub-pixels emitting green light in the first display area of the designated sample display panel at the first gray level, and Ave_main_g1 is an average value of second brightness parameters of the second sub-pixels emitting green light in the second display area of the designated sample display panel at the first gray level.

The second to-be-tested brightness parameter comprises a quotient of an average value of the third brightness parameters and an average value of the fourth brightness parameters. The average value of the third brightness parameters is an average value of the third brightness parameters of the first sub-pixels emitting lights of respective target colors in the first display area of the target display panel at the first gray level. The average value of the fourth brightness parameters is an average value of the fourth brightness parameters of the second sub-pixels emitting lights of respective target colors in a second display area of the target display panel at the first gray level. For example, the above relationship may be expressed as y_r2=Ave_Local_r2/Ave_main_r2, wherein, y_r2 is the second to-be-tested brightness parameter corresponding to the sub-pixels emitting red light of the target display panel at the first gray level, Ave_Local_r2 is an average value of third brightness parameters of the first sub-pixels emitting red light in the first display area of the target display panel at the first gray level, and Ave_main_r2 is an average value of fourth brightness parameters of the second sub-pixels emitting red light in the second display area of the target display panel at the first gray level. For another example, the above relationship may be expressed as y_b2=Ave_Local_b2/Ave_main_b2, wherein, y_b2 is the second to-be-tested brightness parameter corresponding to the sub-pixels emitting blue light of the target display panel at the first gray level, Ave_Local_b2 is an average value of third brightness parameters of the first sub-pixels emitting blue light in the first display area of the target display panel at the first gray level, and Ave_main_b2 is an average value of fourth brightness parameters of the second sub-pixels emitting blue light in the second display area of the target display panel at the first gray level. For yet another example, the above relationship may be expressed as y_g2=Ave_Local_g2/Ave_main_g2, wherein, y_g2 is the second to-be-tested brightness parameter corresponding to the sub-pixels emitting green light of the target display panel at the first gray level, Ave_Local_g2 is an average value of third brightness parameters of the first sub-pixels emitting green light in the first display area of the target display panel at the first gray level, and Ave_main_g2 is an average value of fourth brightness parameters of the second sub-pixels emitting green light in the second display area of the target display panel at the first gray level.

The first to-be-tested brightness parameter may represent the discrete degree of the brightness values of the first display area and the second display area of the designated sample display panel. The brightness compensation of the designated sample display panel may be implemented by applying a compensation algorithm with the first to-be-tested brightness parameter.

In other alternative examples, the first to-be-tested brightness parameter comprises a difference value between an average value of the first brightness parameters and an average value of the second brightness parameters. For the definitions of the average value of the first brightness parameters and the average value of the second brightness parameters, reference may be made to the above related descriptions, which will not be repeated here. For example, the above relationship may be expressed as y_r1=Ave_Local_r1-Ave_main_r1, wherein, y_r1 is the first to-be-tested brightness parameter corresponding to the sub-pixels emitting red light of the designated sample display panel at the first gray level, Ave_Local_r1 is an average value of first brightness parameters of the first sub-pixels emitting red light in the first display area of the designated sample display panel at the first gray level, and Ave_main_r1 is an average value of second brightness parameters of the second sub-pixels emitting red light in the second display area of the designated sample display panel at the first gray level. For another example, the above relationship may be expressed as y_b1=Ave_Local_b1-Ave_main_b1, wherein, y_b1 is the first to-be-tested brightness parameter corresponding to the sub-pixels emitting blue light of the designated sample display panel at the first gray level, Ave_Local_b1 is an average value of first brightness parameters of the first sub-pixels emitting blue light in the first display area of the designated sample display panel at the first gray level, and Ave_main_b1 is an average value of second brightness parameters of the second sub-pixels emitting blue light in the second display area of the designated sample display panel at the first gray level. For yet another example, the above relationship may be expressed as y_g1=Ave_Local_g1−Ave_main_g1, wherein, y_g1 is the first to-be-tested brightness parameter corresponding to the sub-pixels emitting green light of the designated sample display panel at the first gray level, Ave_Local_g1 is an average value of first brightness parameters of the first sub-pixels emitting green light in the first display area of the designated sample display panel at the first gray level, and Ave_main_g1 is an average value of second brightness parameters of the second sub-pixels emitting green light in the second display area of the designated sample display panel at the first gray level.

The second to-be-tested brightness parameter comprises a difference value between an average value of the third brightness parameters and an average value of the fourth brightness parameters. For the definitions of the average value of the third brightness parameters and the average value of the fourth brightness parameters, reference may be made to the above related descriptions, which will not be repeated here. For example, the above relationship may be expressed as y_r2=Ave_Local_r2-Ave_main_r2, wherein, y_r2 is the second to-be-tested brightness parameter corresponding to the sub-pixels emitting red light of the target display panel at the first gray level, Ave_Local_r2 is an average value of third brightness parameters of the first sub-pixels emitting red light in the first display area of the target display panel at the first gray level, and Ave_main_r2 is an average value of fourth brightness parameters of the second sub-pixels emitting red light in the second display area of the target display panel at the first gray level. For another example, the above relationship may be expressed as y_b2=Ave_Local_b2-Ave_main_b2, wherein, y_b2 is the second to-be-tested brightness parameter corresponding to the sub-pixels emitting blue light of the target display panel at the first gray level, Ave_Local_b2 is an average value of third brightness parameters of the first sub-pixels emitting blue light in the first display area of the target display panel at the first gray level, and Ave_main_b2 is an average value of fourth brightness parameters of the second sub-pixels emitting blue light in the second display area of the target display panel at the first gray level. For yet another example, the above relationship may be expressed as y_g2=Ave_Local_g2-Ave_main_g2, wherein, y_g2 is the second to-be-tested brightness parameter corresponding to the sub-pixels emitting green light of the target display panel at the first gray level, Ave_Local_g2 is an average value of third brightness parameters of the first sub-pixels emitting green light in the first display area of the target display panel at the first gray level, and Ave_main_g2 is an average value of fourth brightness parameters of the second sub-pixels emitting green light in the second display area of the target display panel at the first gray level.

Figure 7:
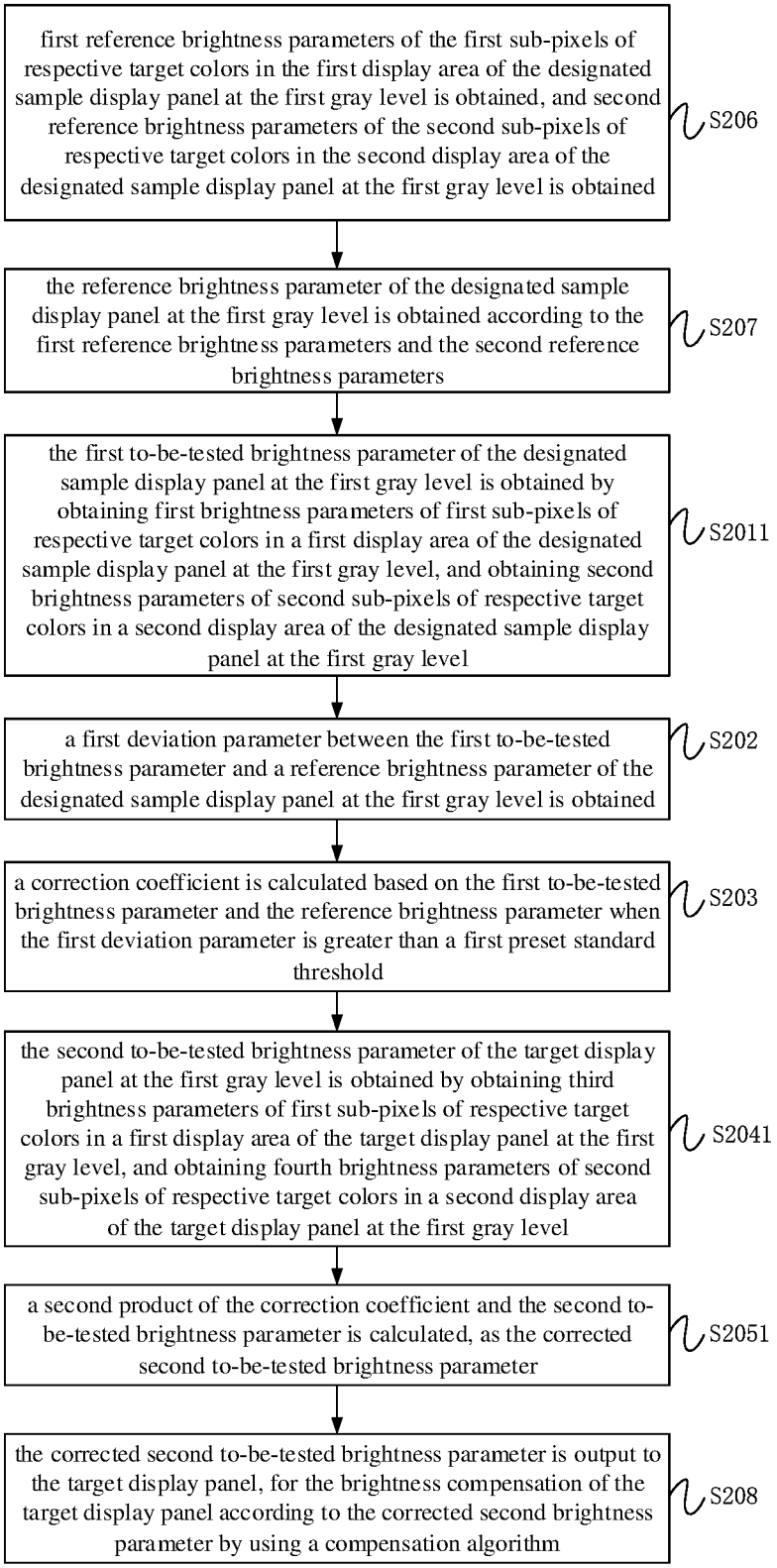
FIG. 7 is a flowchart of yet another example of a brightness parameter correction method according to an embodiment of the present application.

FIG. 7 is a flowchart of yet another example of a brightness parameter correction method according to an embodiment of the present application. The difference between FIG. 7 and FIG. 4 is that the step S205 in FIG. 4 may be particularly specified as step S2051 in FIG. 7, and the brightness parameter correction method shown in FIG. 7 may further include steps S206, S207 and S208.

In step 2051, a second product of the correction coefficient and the second to-be-tested brightness parameter is calculated, as the corrected second to-be-tested brightness parameter.

In some examples, the corrected first to-be-tested brightness parameter in the above embodiment is a first product of the correction coefficient and the first to-be-tested brightness parameter. For example, this relationship may be expressed as y_r1'=y_r1×r_diff, wherein, y_r1 is the first to-be-tested brightness parameter corresponding to the sub-pixels emitting red light of the designated sample display panel at the first gray level, and y_r1' is the corrected first to-be-tested brightness parameter corresponding to the sub-pixels emitting red light of the designated sample display panel at the first gray level, and r_diff is the correction coefficient corresponding to the first to-be-tested brightness parameter.

The correction coefficient corresponding to the first to-be-tested brightness parameter may be correspondingly applied to the correction of the second to-be-tested brightness parameter. In particular, the corrected second to-be-tested brightness parameter is the second product of the correction coefficient and the second to-be-tested brightness parameter. For example, this relationship may be expressed as $y_r2'=y_r2\times r_diff$, wherein, y_r2 is the second to-be-tested brightness parameter corresponding to the sub-pixels emitting red light of the target display panel at the first gray level, and y_r2' is the corrected second to-be-tested brightness parameter corresponding to the sub-pixels emitting red light of the target display panel at the first gray level, r_diff is the correction coefficient corresponding to the second to-be-tested brightness parameter. The correction coefficient corresponding to a second to-be-tested brightness parameter obtained by the present machine may be the same as the correction coefficient corresponding to a first to-be-tested brightness parameter obtained by the present machine.

In step S206, first reference brightness parameters of the first sub-pixels emitting lights of respective target colors in the first display area of the designated sample display panel at the first gray level are obtained, and second reference brightness parameters of the second sub-pixels emitting lights of respective target colors in the second display area of the designated sample display panel at the first gray level are obtained.

The first reference brightness parameters may be first brightness parameters of the first sub-pixels emitting lights of respective target colors in the first display area of the designated sample display panel at the first gray level and in an ideal state. The second reference brightness parameters may be second brightness parameters of the second sub-pixels emitting lights of respective target colors in the second display area of the designated sample display panel at the first gray level and in an ideal state.

In step S207, the reference brightness parameter of the designated sample display panel at the first gray level is obtained based on the first reference brightness parameters and the second reference brightness parameters.

The reference brightness parameter may represent a discrete degree of brightness values of the first display area and brightness values of the second display area of the designated sample display panel in an ideal state.

In some examples, the reference brightness parameter includes a quotient of an average value of the first reference brightness parameters and an average value of the second reference brightness parameters.

In other alternative examples, the reference brightness parameter includes a difference value between an average value of the first reference brightness parameters and an average value of the second reference brightness parameters.

The above average value of the first reference brightness parameters is an average value of the obtained first reference brightness parameters of the first sub-pixels emitting lights of respective target colors in the first display area of the designated sample display panel at the first gray level. The above average value of the second reference brightness parameters is an average value of the obtained second reference brightness parameters of the second sub-pixels emitting lights of respective target colors in the second display area of the designated sample display panel at the first gray level.

In step S208, the corrected second to-be-tested brightness parameter is output to the target display panel, so as to perform the brightness compensation on the target display panel by applying a compensation algorithm with the corrected second brightness parameter.

The corrected second to-be-tested brightness parameter may represent a discrete degree of the brightness values of different portions of the display area of the target display panel after the adverse influence resulting from the poor consistency and the poor stability of the different machines have been eliminated. For example, the corrected second to-be-tested brightness parameter may represent a discrete degree of the brightness values of the first display area and the brightness values of the second display area of the target display panel after the adverse influence resulting from the poor consistency and the poor stability of the different machines have been eliminated. Applying the compensation algorithm to perform the brightness compensation on the target display panel with the corrected second to-be-tested brightness parameter may eliminated the adverse influence resulting from the poor consistency and the poor stability of the different machines, thereby improving the compensation effects. Especially, for the situation that a plurality of the machines are used for brightness compensation for a plurality of the target display panels of the same type, the compensation effects of the brightness compensation for the target display panels can be significantly improved, as the adverse influence resulting from the poor consistency and the poor stability of the machines can be eliminated.

Figure 8:
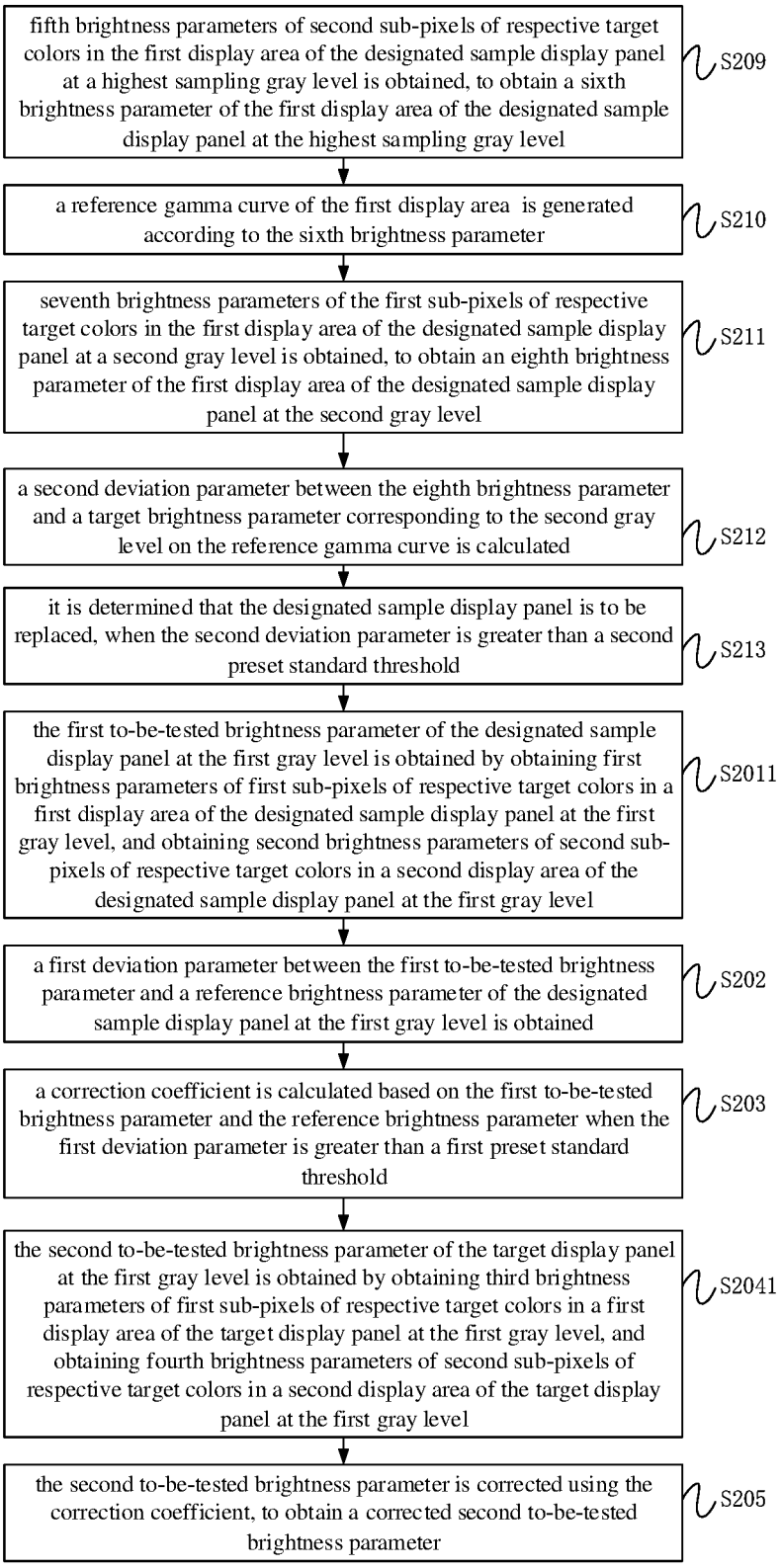
FIG. 8 is a flowchart of yet another example of a brightness parameter correction method according to an embodiment of the present application.

FIG. 8 is a flowchart of yet another example of a brightness parameter correction method according to an embodiment of the present application. The difference between FIG. 8 and FIG. 4 is that the brightness parameter correction method shown in FIG. 8 may further include steps S209 to S213.

In step S209, fifth brightness parameters of the second sub-pixels emitting lights of respective target colors in the first display area of the designated sample display panel at a highest sampling gray level are obtained, to obtain a sixth brightness parameter of the first display area of the designated sample display panel at the highest sampling gray level.

The highest sampling gray level is a maximum gray level that the present machine can sampled when obtaining the brightness parameters, which is not limited here. For example, the highest sampling gray level may be a gray level of 255. In some examples, the sixth brightness parameter corresponding to the sub-pixels emitting lights of respective target colors of the first display area of the designated sample display panel at the highest sampling gray level may be an average value of the fifth brightness parameters of the second sub-pixels emitting lights of respective target colors in the first display area of the designated sample display panel at the highest sampling gray level. The fifth brightness parameters and the sixth brightness parameter may particularly be brightness values, but are not limited herein.

In step S210, a reference gamma curve of the first display area is generated based on the sixth brightness parameter.

In some examples, the sixth brightness parameter corresponding to the sub-pixels emitting lights of respective target colors of the first display area of the designated sample display panel at the highest sampling gray level may be an average value of the fifth brightness parameters of the second sub-pixels emitting lights of respective target colors in the first display area of the designated sample display panel at the highest sampling gray level. The sixth brightness parameter may be used as a brightness value corresponding to the highest sampling gray level on the reference gamma curve of the first display area. With respect to the sub-pixels emitting lights of each color, a corresponding reference gamma curve may be generated. For example, if the light colors for the sub-pixels include blue, red and green, a reference gamma curve corresponding to the sub-pixels emitting blue light, a reference gamma curve corresponding to the sub-pixels emitting red light, and a reference gamma curve corresponding to the sub-pixels emitting green light may be generated respectively.

In step S211, seventh brightness parameters of the first sub-pixels emitting lights of respective target colors in the first display area of the designated sample display panel at a second gray level are obtained, to obtain an eighth brightness parameter of the first display area of the designated sample display panel at the second gray level.

The second gray level is a gray level other than the highest sampling gray level, which is not limited herein. The seventh brightness parameters may particularly be brightness values, which is not limited herein. In some examples, the eighth brightness parameter of the first display area of the designated sample display panel at the second gray level may be an average value of the seventh brightness parameters of the first sub-pixels emitting lights of respective target colors in the first display area of the designated sample display panel at a second gray level.

In step S212, a second deviation parameter between the eighth brightness parameter and a target brightness parameter corresponding to the second gray level on the reference gamma curve is calculated.

The second deviation parameter may represent a degree of deviation of the eighth brightness parameter from the target brightness parameter corresponding to the second gray level on the reference gamma curve. In some examples, the second deviation parameter may particular be an absolute value of a difference between the eighth brightness parameter and the target brightness parameter corresponding to the second gray level on the reference gamma curve. In some alternative examples, the second deviation parameter may particularly be a quotient of an absolute value of a difference between the eighth brightness parameter and the target brightness parameter corresponding to the second gray level on the reference gamma curve and the target brightness parameter. The form of the second deviation parameter is not limited here.

In step S213, it is determined that the designated sample display panel is to be replaced if the second deviation parameter is greater than a second preset standard threshold.

In some examples, the second preset standard threshold is a standard threshold for an absolute value of a difference between the eighth brightness parameter and the target brightness parameter corresponding to the second gray level on the reference gamma curve, for example, the second preset standard threshold may be set to 0.2. In some other examples, the second preset standard threshold is a standard threshold for a quotient of an absolute value of a difference between the eighth brightness parameter and the target brightness parameter corresponding to the second gray level on the reference gamma curve and the target brightness parameter, and for example, the second preset standard threshold may be set to 2%. The second preset standard threshold and the first preset standard threshold may be set independently with each other, and they may be set as equal or unequal to each other, which is not limited herein.

The second deviation parameter being greater than the second preset standard threshold indicates that the designated sample display panel itself may have quality defects and is not suitable as a designated sample display panel for the following brightness parameter correction processes including steps S201 to S205 among others. This designated sample display panel should be replaced. After this designated sample display panel is replaced, the above steps S209 to S213 may be performed on the replaced designated sample display panel, as long as a second deviation parameter corresponding to the replaced designated sample display panel is less than or equal to the second preset standard threshold.

The designated sample display panel may be replaced if a second deviation parameter related to a reference gamma curve corresponding to the sub-pixels emitting lights of at least one color is greater than the second preset standard threshold.

The generated reference gamma curve is used for testing the designated sample display panel to avoid using a display panel with quality defects for brightness parameter correction, so as to avoid further adverse influence caused by the display panel with quality defects as a designated sample display panel. Thus, the compensation effects of the brightness compensation may be guaranteed.

Figure 9:
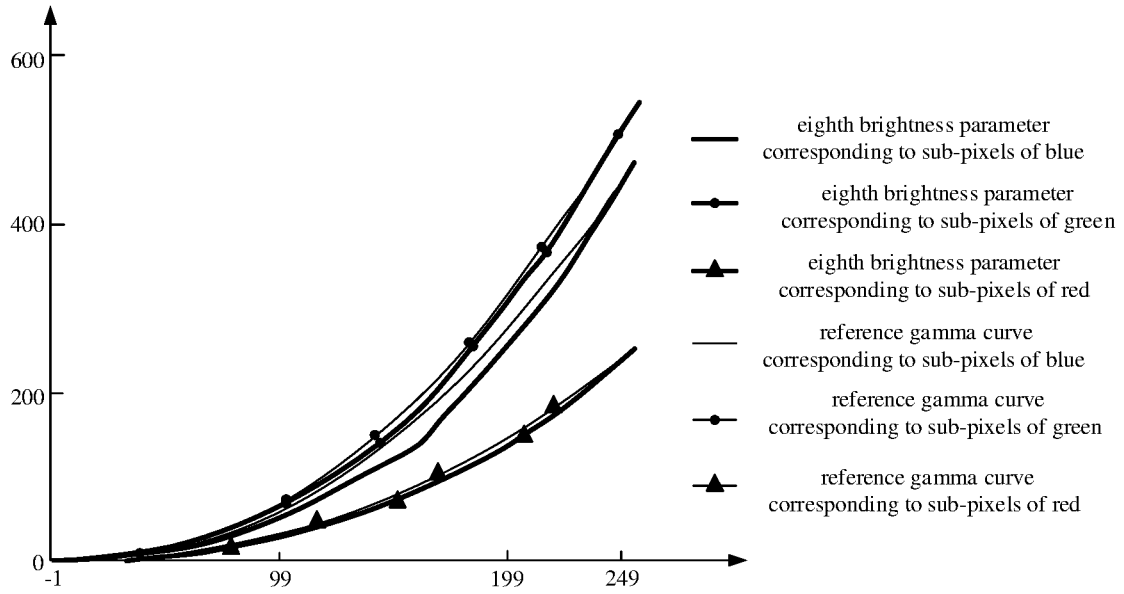
FIG. 9 is a schematic diagram of an example of the comparison between the reference gamma curves and the respective eighth brightness parameters according to an embodiment of the present application.

FIG. 9 is a schematic diagram of an example of the comparisons between the reference gamma curves and the respective eighth brightness parameters according to an embodiment of the present application. As shown in FIG. 9, the abscissa axis represents the gray level, and the ordinate axis represents the brightness value. In FIG. 9, the degrees of deviation of some eighth brightness parameters of the sub-pixels emitting red light at some gray levels from respective target brightness parameters corresponding the sub-pixels emitting red light at these gray levels on the reference gamma curve are within an acceptable range; the degrees of deviation of some eighth brightness parameters of the sub-pixels emitting green light at some gray levels from respective target brightness parameters corresponding the sub-pixels emitting green light at these gray levels on the reference gamma curve are within an acceptable range; and the degrees of deviation of some eighth brightness parameters of the sub-pixels emitting blue light at some gray levels from respective target brightness parameters corresponding the sub-pixels emitting blue light at these gray levels on the reference gamma curve have exceed an acceptable range, which means that this designated sample display panel needs to be replaced.

Figure 10:
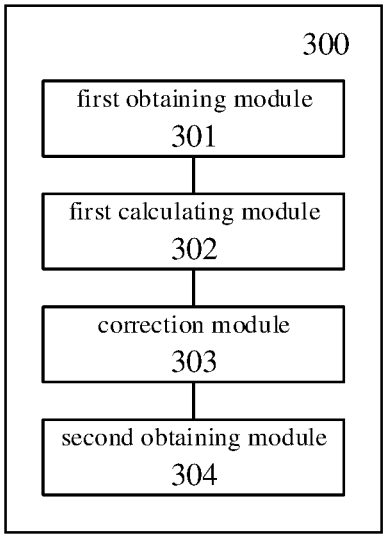
FIG. 10 is a schematic structure diagram of an example of a brightness parameter correction apparatus according to an embodiment of the present application.

Embodiments of the present application also provide a brightness parameter correction apparatus. The brightness parameter correction apparatus may be used for the display panels in the above embodiments. For the detailed description of the display panels, reference may be made to the relevant description in the above embodiments, which will not be repeated here. FIG. 10 is a schematic structure diagram of an example of a brightness parameter correction apparatus according to an embodiment of the present application. As shown in FIG. 10, the brightness parameter correction apparatus 300 may include a first obtaining module 301, a first calculating module 302, a correction module 303 and a second obtaining module 304.

The first obtaining module 301 may be configured to obtain a first to-be-tested brightness parameter of a designated sample display panel at a first gray level.

The first calculating module 302 may be configured to obtain a first deviation parameter between the first to-be-tested brightness parameter and a reference brightness parameter of the designated sample display panel at the first gray level.

The correction module 303 may be configured to calculate a correction coefficient based on the first to-be-tested brightness parameter and the reference brightness parameter if the first deviation parameter is greater than a first preset standard threshold.

The first to-be-tested brightness parameter is corrected using the correction coefficient so that the first deviation parameter between the corrected first to-be-tested brightness parameter and the reference brightness parameter is less than or equal to the first preset standard threshold.

The second obtaining module 304 may be configured to obtain a second to-be-tested brightness parameter of a target display panel at the first gray level.

The correction module 303 may be further configured to correct the second to-be-tested brightness parameter using the correction coefficient to obtain a corrected second to-be-tested brightness parameter.

The corrected second to-be-tested brightness parameter is used for a brightness compensation of the target display panel.

In the embodiments of the present application, a first to-be-tested brightness parameter may be obtained. A correction coefficient is calculated based on the first to-be-tested brightness parameter and a reference brightness parameter of the designated sample display panel if a first deviation parameter between the first to-be-tested brightness parameter and the reference brightness parameter is greater than a first preset standard threshold. The first to-be-tested brightness parameter is corrected using the correction coefficient so that the first deviation parameter between the corrected first to-be-tested brightness parameter and the reference brightness parameter is less than or equal to the first preset standard threshold. That is, the correction coefficient may eliminate the adverse influence resulting from poor consistency and poor stability of the machines used for brightness compensation. Therefore, for the target display panels needing the brightness compensation, the second to-be-tested brightness parameter corrected with the correction coefficient may eliminate the adverse influence resulting from the poor consistency and the poor stability of the machines used for the brightness compensation, and the compensation effects of the compensation algorithm can be improved by performing the brightness compensation on the target display panels with the corrected second to-be-tested brightness parameter. Especially, for the situation that a plurality of the machines are used for the brightness compensation for a plurality of the target display panels of the same type, the compensation effects of the brightness compensation for the target display panels can be significantly improved, as the adverse influence resulting from the poor consistency and the poor stability of the machines can be eliminated.

Moreover, in the embodiments of the present application, the adverse influence resulting from the poor consistency and the poor stability of the different machines can be eliminated by the correction coefficient. Thus, for the situation that a plurality of the machines are used for the brightness compensation for a plurality of the target display panels of the same type, the brightness parameter correction method according to the embodiments of the present application may be applied to each of the machines, and it is not necessary to configure the plurality of the machines with different compensation algorithms That is, configuring one compensation algorithm for the plurality of machines may realize the function of providing accurate brightness compensation for the plurality of the target display panels of the same type, which may further avoid incorrect operation in loading a plurality of different compensation algorithms and problems of the undesirable compensation effects resulting from unsuitable compensation algorithms loaded onto the machines.

In some examples, the designated sample display panel and the target display panel correspond to a display panel that has a first display area and a second display area. The first display area is disposed with a plurality of first sub-pixels, and the second display area is disposed with a plurality of second sub-pixels.

The first obtaining module 301 may be particularly configured to: obtain the first to-be-tested brightness parameter of the designated sample display panel at the first gray level by obtaining first brightness parameters of the first sub-pixels emitting lights of respective target colors in the first display area of the designated sample display panel at the first gray level, and second brightness parameters of the second sub-pixels emitting lights of respective target colors in the second display area of the designated sample display panel at the first gray level.

The second obtaining module 304 may be particularly configured to: obtain the second to-be-tested brightness parameter of the target display panel at the first gray level by obtaining third brightness parameters of the first sub-pixels emitting lights of respective target colors in the first display area of the target display panel at the first gray level, and fourth brightness parameters of the second sub-pixels emitting lights of respective target colors in the second display area of the target display panel at the first gray level.

In some examples, the first to-be-tested brightness parameter comprises a quotient of an average value of the first brightness parameters and an average value of the second brightness parameters. The second to-be-tested brightness parameter comprises a quotient of an average value of the third brightness parameters and an average value of the fourth brightness parameters.

In other examples, the first to-be-tested brightness parameter comprises a difference value between an average value of the first brightness parameters and an average value of the second brightness parameters. The second to-be-tested brightness parameter comprises a difference value between an average value of the third brightness parameters and an average value of the fourth brightness parameters.

In some examples, the corrected first to-be-tested brightness parameter in the above embodiment is a first product of the correction coefficient and the first to-be-tested brightness parameter.

The correction module 303 may be particular configured to calculate a second product of the correction coefficient and the second to-be-tested brightness parameter, as the corrected second to-be-tested brightness parameter.

Figure 11:
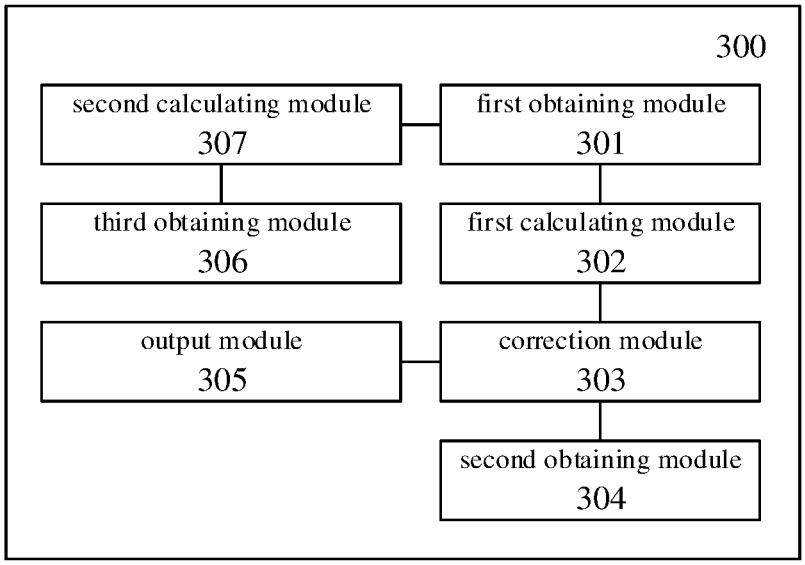
FIG. 11 is a schematic structure diagram of another example of a brightness parameter correction apparatus according to an embodiment of the present application.

FIG. 11 is a schematic structure diagram of another example of a brightness parameter correction apparatus according to an embodiment of the present application. The difference between FIG. 11 and FIG. 10 is that the brightness parameter correction apparatus 300 shown in FIG. 11 may further include an output module 305, a third obtaining module 306 and a second calculating module 307.

The output module 305 may be configured to output the corrected second to-be-tested brightness parameter to the target display panel, so as to perform the brightness compensation on the target display panel by applying a compensation algorithm with the corrected second brightness parameter by using a compensation algorithm.

The third obtaining module 306 may be configured to obtain first reference brightness parameters of the first sub-pixels emitting lights of respective target colors in the first display area of the designated sample display panel at the first gray level, and second reference brightness parameters of the second sub-pixels emitting lights of respective target colors in the second display area of the designated sample display panel at the first gray level.

The second calculating module 307 may be configured to obtain the reference brightness parameter of the designated sample display panel at the first gray level based on the first reference brightness parameters and the second reference brightness parameters.

In some examples, the reference brightness parameter comprises a quotient of an average value of the first reference brightness parameters and an average value of the second reference brightness parameters.

In other examples, the reference brightness parameter comprises a difference value between an average value of the first reference brightness parameters and an average value of the second reference brightness parameters.

Figure 12:
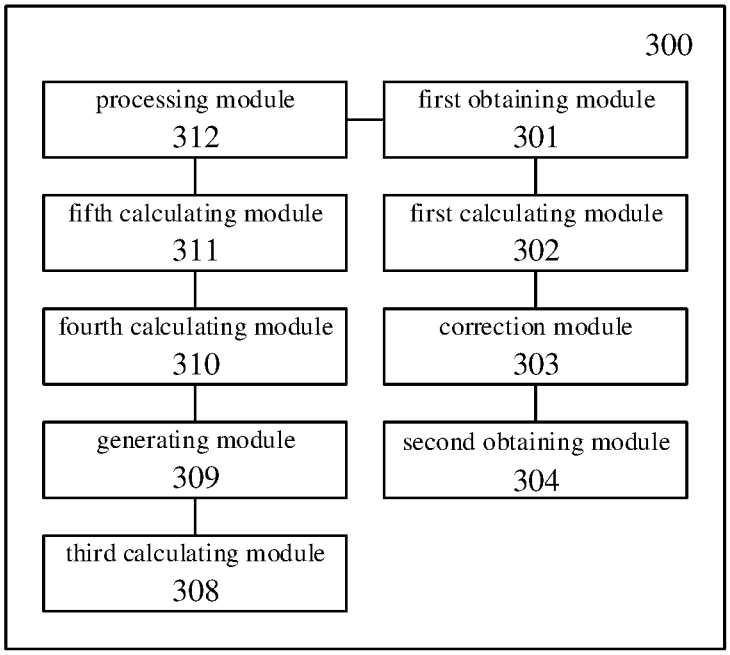
FIG. 12 a schematic structure diagram of yet another example of a brightness parameter correction apparatus according to an embodiment of the present application.

FIG. 12 a schematic structure diagram of yet another example of a brightness parameter correction apparatus according to an embodiment of the present application. The difference between FIG. 12 and FIG. 10 is that the brightness parameter correction apparatus 300 shown in FIG. 12 may further include a third calculating module 308, a generating module 309, a fourth calculating module 310, a fifth calculating module 311 and a processing module 312.

The third calculating module 308 may be configured to obtain fifth brightness parameters of the second sub-pixels emitting lights of respective target colors in the first display area of the designated sample display panel at a highest sampling gray level, to obtain a sixth brightness parameter of the first display area of the designated sample display panel at the highest sampling gray level.

The generating module 309 may be configured to generate a reference gamma curve of the first display area based on the sixth brightness parameter.

The fourth calculating module 310 may be configured to obtain seventh brightness parameters of the first sub-pixels emitting lights of respective target colors in the first display area of the designated sample display panel at a second gray level, to obtain an eighth brightness parameter of the first display area of the designated sample display panel at the second gray level.

The fifth calculating module 311 may be configured to calculate a second deviation parameter between the eighth brightness parameter and a target brightness parameter corresponding to the second gray level on the reference gamma curve.

The processing module 312 may be configured to determine that the designated sample display panel is to be replaced if the second deviation parameter is greater than a second preset standard threshold.

Figure 13:
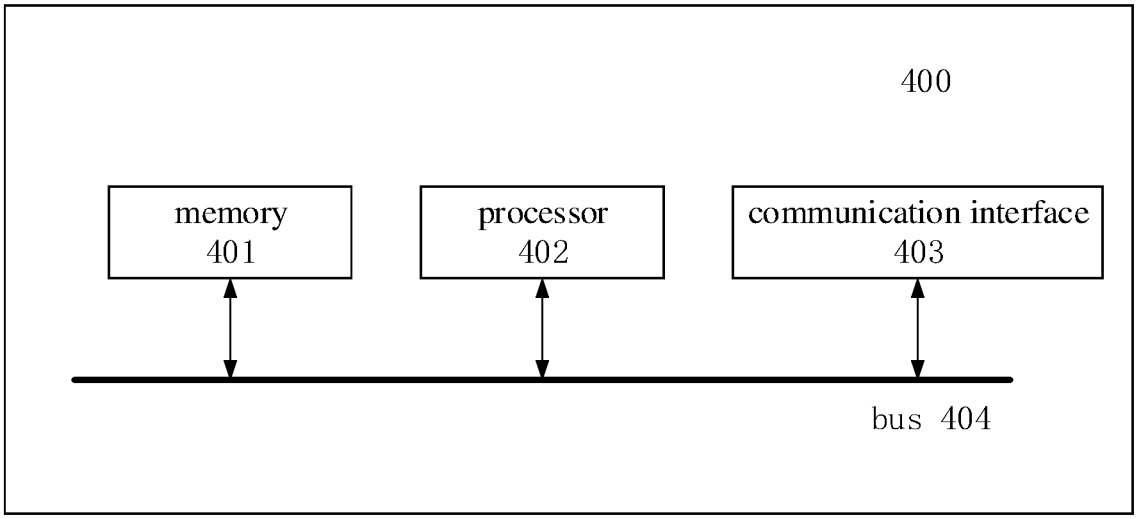
FIG. 13 is a schematic structure diagram of an example of a brightness parameter correction device according to an embodiment of the present application.

The embodiments of the present application further provide a brightness parameter correction device, and the brightness parameter correction device may be implemented as the above machine for brightness compensation or any other independent device, which is not limited herein. FIG. 13 is a schematic structure diagram of an example of a brightness parameter correction device according to an embodiment of the present application. As shown in FIG. 13, the brightness parameter correction device 400 includes a memory 401, a processor 402, and a computer program stored on the memory 401 and executable by the processor 402.

In one example, the above processor 402 may include a central processing unit (CPU), or a specific integrated circuit (ASIC), or may be configured as integrated circuits for implementing one or more of embodiments of the present application.

Memory 401 may include mass storage for data or instructions. By way of example and not limitation, memory 401 may include an HDD, floppy disk drive, flash memory, optical disk, magneto-optical disk, magnetic tape, or universal serial bus (USB) drive, or a combination of two or more of the above. For example, memory 401 may include removable or non-removable (or fixed) media. For example, the memory 401 may by turned on by terminal hotspot inside or outside the brightness parameter correction device 400. In some embodiments, memory 401 is non-volatile solid state memory. In particular embodiments, memory 401 includes read only memory (ROM). For example, the ROM may be a mask programmed ROM, programmable ROM (PROM), erasable PROM (EPROM), electrically erasable PROM (EEPROM), electrically rewritable ROM (EAROM) or flash memory or a combination of two or more of the above.

The processor 402 executes a computer program corresponding to an executable program code by reading the executable program code from the memory 401, so as to implement the brightness parameter correction method according to the above-mentioned embodiments.

In one example, the brightness parameter correction device 400 may further include a communication interface 403 and a bus 404. For example, as shown in FIG. 13, the memory 401, the processor 402, and the communication interface 403 connect and communicate with one another via the bus 404.

The communication interface 403 is mainly configured to implement communication between modules, apparatus, units and/or devices in the embodiments of the present application. Input devices and/or output devices may also be accessed via the communication interface 403.

The bus 404 includes hardware, software, or both, which may couple the components of the brightness parameter correction device 400 to one another. By way of example and not limitation, the bus 404 may include Accelerated Graphics Port (AGP) or other graphics bus, Enhanced Industry Standard Architecture (EISA) bus, Front Side Bus (FSB), HyperTransport (HT) interconnect, Industry Standard Architecture (ISA)) bus, Infiniband Interconnect, Low Pin Count (LPC) bus, Memory Bus, Microchannel Architecture (MCA) bus, Peripheral Component Interconnect (PCI) bus, PCI-Express (PCI-X) bus, Serial Advanced Technology Attachment (SATA) bus, Video Electronics Standards Association Local (VLB) bus or other suitable bus or a combination of two or more of the above. For example, the bus 404 may include one or more buses. Although the embodiments of the present application describe and illustrate the particular buses, the present application may include any suitable bus or interconnect.

Embodiments of the present application further provide a computer readable storage medium on which a computer program is stored, and the computer program when executed by a processor may cause the processor to implement the brightness parameter correction method according to one of the above embodiments, and to achieve the same technical effects as above, which will not be repeated here. The computer readable storage medium may include a Read-Only Memory (ROM), a Random Access Memory (RAM), a magnetic disk or an optical disk, etc., which are not limited herein.

Figure 14:
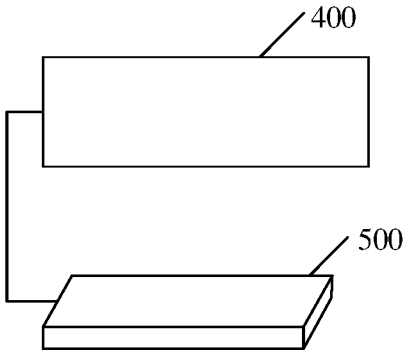
FIG. 14 is a schematic structure diagram of an example of a brightness compensation system according to an embodiment of the present application.

Embodiments of the present application further provide a brightness compensation system. FIG. 14 is a schematic structure diagram of an example of a brightness compensation system according to an embodiment of the present application. As shown in FIG. 14, the brightness compensation system may include the brightness parameter correction device 400 and the display panel 500 in the above embodiments. The brightness parameter correction device 400 may execute the above brightness parameter correction method, and output the corrected second to-be-tested brightness parameter to the display panel 500. The display panel 500 may particularly be a target display panel in the above embodiments. The display panel 500 receives the corrected second to-be-tested brightness parameter output by the brightness parameter correction device 400, and may perform brightness compensation for the display panel 500 itself by applying a compensation algorithm with the corrected second to-be-tested brightness parameter.

It should be clear that each embodiment in this application is described in a progressive manner, and the same or similar parts of the various embodiments may be referred to one another, and each embodiment is descripted by only focusing on the differences from other embodiments. For the apparatus embodiments, device embodiments, storage medium embodiments and system embodiments, reference may be made to the related description of the method embodiments. The present application is not limited to the specific structures described above and shown in the figures. A person skilled in the art should understand that the above embodiments are all illustrative and not restrictive. Different technical features presenting in different embodiments may be combined with one another, to achieve beneficial effects. A person skilled in the art will understand and implement other variant embodiments of the disclosed embodiments on the basis of studying the drawings, the description and the claims.

A person skilled in the art should understand that the above-mentioned embodiments are all illustrative and not restrictive. Different technical features presenting in different embodiments may be combined with one another, to achieve beneficial effects. A person skilled in the art will understand and implement other variant embodiments of the disclosed embodiments on the basis of studying the drawings, the description and the claims. In the claims, the term "comprising" does not exclude other means or steps; the term "a" does not exclude a plurality; the terms "first" and "second" are used to denote names rather than any particular order. Any reference signs in the claims shall not be construed as limiting the scope. The functions of several parts presented in the claims may be implemented by a single hardware or software module. The fact that certain technical features are presented in different dependent claims does not imply that these features may not be combined to achieve certain advantages.

What is claimed is:

1. A brightness parameter correction method, comprising:

obtaining a first to-be-tested brightness parameter of a designated sample display panel at a first gray level;

obtaining a first deviation parameter between the first to-be-tested brightness parameter and a reference brightness parameter of the designated sample display panel at the first gray level;

calculating a correction coefficient based on the first to-be-tested brightness parameter and the reference brightness parameter when the first deviation parameter is greater than a first preset standard threshold, the correction coefficient being such that a corrected first deviation parameter between a corrected first to-be-tested brightness parameter using the correction coefficient and the reference brightness parameter is less than or equal to the first preset standard threshold;

obtaining a second to-be-tested brightness parameter of a target display panel at the first gray level; and correcting the second to-be-tested brightness parameter using the correction coefficient to obtain a corrected second to-be-tested brightness parameter for a brightness compensation of the target display panel;

wherein the designated sample display panel and the target display panel correspond to display panel, the display panel has a first display area and a second display area, the first display area is disposed with a plurality of first sub-pixels, and the second display area is disposed with a plurality of second sub-pixels; and wherein obtaining the first to-be-tested brightness parameter of the designated sample display panel at the first gray level comprises:

obtaining first brightness parameters of the first sub-pixels of respective target colors in the first display area of the designated sample display panel at the first gray level, and second brightness parameters of the second sub-pixels of respective target colors in the second display area of the designated sample display panel at the first gray level, to obtain the first to-be-tested brightness parameter of the designated sample display panel at the first gray level.

2. The brightness parameter correction method according to claim 1, wherein obtaining the second to-be-tested brightness parameter of the target display panel at the first gray level comprises:

obtaining third brightness parameters of the first sub-pixels of respective target colors in the first display area of the target display panel at the first gray level, and fourth brightness parameters of the second sub-pixels of respective target colors in the second display area of the target display panel at the first gray level, to obtain the second to-be-tested brightness parameter of the target display panel at the first gray level.

3. The brightness parameter correction method according to claim 2, wherein the first to-be-tested brightness parameter comprises a quotient of an average value of the first brightness parameters and an average value of the second brightness parameters, and the second to-be-tested brightness parameter comprises a quotient of an average value of the third brightness parameters and an average value of the fourth brightness parameters.

4. The brightness parameter correction method according to claim 2, wherein the first to-be-tested brightness parameter comprises a difference value between an average value of the first brightness parameters and an average value of the second brightness parameters, and the second to-be-tested brightness parameter comprises a difference value between an average value of the third brightness parameters and an average value of the fourth brightness parameters.

5. The brightness parameter correction method according to claim 1, wherein the corrected first to-be-tested brightness parameter is a first product of the correction coefficient and the first to-be-tested brightness parameter.

6. The brightness parameter correction method according to claim 5, wherein correcting the second to-be-tested brightness parameter using the correction coefficient to obtain the corrected second to-be-tested brightness parameter comprises:

calculating a second product of the correction coefficient and the second to-be-tested brightness parameter, as the corrected second to-be-tested brightness parameter.

7. The brightness parameter correction method according to claim 1, wherein after the correcting the second to-be-tested brightness parameter using the correction coefficient to obtain the corrected second to-be-tested brightness parameter, the method further comprises:

outputting the corrected second to-be-tested brightness parameter to the target display panel, for the brightness compensation of the target display panel according to the corrected second brightness parameter by using a compensation algorithm.

8. The brightness parameter correction method according to claim 1, wherein before the obtaining the first to-be-tested brightness parameter of the designated sample display panel at the first gray level, the method further comprises:

obtaining fifth brightness parameters of second sub-pixels of respective target colors in the first display area of the designated sample display panel at a highest sampling gray level, to obtain a sixth brightness parameter of the first display area of the designated sample display panel at the highest sampling gray level;

generating a reference gamma curve of the first display area according to the sixth brightness parameter;

obtaining seventh brightness parameters of the first sub-pixels of respective target colors in the first display area of the designated sample display panel at a second gray level, to obtain an eighth brightness parameter of the first display area of the designated sample display panel at the second gray level;

calculating a second deviation parameter between the eighth brightness parameter and a target brightness parameter corresponding to the second gray level on the reference gamma curve; and determining that the designated sample display panel is to be replaced, when the second deviation parameter is greater than a second preset standard threshold.

9. The brightness parameter correction method according to claim 1, wherein before the obtaining the first deviation parameter between the first to-be-tested brightness parameter and the reference brightness parameter of the designated sample display panel at the first gray level, the method further comprises:

obtaining first reference brightness parameters of the first sub-pixels of respective target colors in the first display area of the designated sample display panel at the first gray level, and second reference brightness parameters of the second sub-pixels of respective target colors in the second display area of the designated sample display panel at the first gray level; and obtaining the reference brightness parameter of the designated sample display panel at the first gray level according to the first reference brightness parameters and the second reference brightness parameters.

10. The brightness parameter correction method according to claim 9, wherein the reference brightness parameter comprises a quotient of an average value of the first reference brightness parameters and an average value of the second reference brightness parameters.

11. The brightness parameter correction method according to claim 9, wherein the reference brightness parameter comprises a difference value between an average value of the first reference brightness parameters and an average value of the second reference brightness parameters.

12. The brightness parameter correction method according to claim 1, further comprising:

generating CSV data by photographing the designated sample display panel, wherein the CSV data comprises the first brightness parameters of the first sub-pixels of respective target colors and the second brightness parameters of the second sub-pixels of respective target colors in a photographed area of the designated sample display panel at the first gray level.

13. The brightness parameter correction method according to claim 12, wherein the photographed area comprises one selected from a group consisting of:

the whole of the first display area and the whole of the second display area;

the whole of the first display area and a portion of the second display area; and a portion of the first display area and a portion of the second display area.

14. The brightness parameter correction method according to claim 13, wherein the portion of the second display area is around the first display area.

15. A brightness parameter correction device, comprising a processor, a memory, and a computer program stored on the memory and executable by the processor, wherein the computer program when executed by the processor causes the processor to implement the brightness parameter correction method according to claim 1.

16. A brightness compensation system, comprising the brightness parameter correction device according to claim 15 and a display panel;

wherein the display panel is configured to receive the corrected second to-be-tested brightness parameter output by the brightness parameter correction device, and perform the brightness compensation according to the corrected second brightness parameter by using a compensation algorithm.

* * * * *